United States Patent [19]

Gazda et al.

[11] 4,149,593

[45] Apr. 17, 1979

[54] WELL TESTING TOOL SYSTEM

[75] Inventors: Imre I. Gazda, Saginaw; George F. Kingelin, Rosenburg, both of Tex.

[73] Assignees: Otis Engineering Corporation, Dallas, Tex.; Gulf Research & Development Company, Pittsburgh, Pa.

[21] Appl. No.: 864,878

[22] Filed: Dec. 27, 1977

[51] Int. Cl.[2] ..... E21B 23/02; E21B 47/00; E21B 47/06

[52] U.S. Cl. ..... 166/113; 166/334; 166/237; 166/64

[58] Field of Search ..... 166/113, 64, 65 R, 237, 166/242, 243, 332, 334, 316, 264

[56] References Cited

U.S. PATENT DOCUMENTS

| | | | |
|---|---|---|---|
| 3,115,188 | 12/1963 | Cochran et al. | 166/332 |
| 3,363,696 | 1/1968 | Berryman | 166/334 |
| 3,581,819 | 6/1971 | Tamplen | 166/332 |
| 3,791,445 | 2/1974 | True | 166/332 X |
| 3,815,675 | 6/1974 | Peters | 166/332 X |
| 3,901,333 | 8/1975 | Mori | 166/334 X |
| 4,069,865 | 1/1978 | Gazda et al. | 166/113 |
| 4,076,077 | 2/1978 | Nix et al. | 166/334 X |

*Primary Examiner*—Stephen J. Novosad

*Attorney, Agent, or Firm*—H. Mathews Garland

[57] ABSTRACT

A well testing tool system for isolating upper and lower portions of a well bore and communicating a well condition such as pressure, temperature, fluid velocity, and the like to a measuring device. The system includes a wireline supported tool train and a locking sub connectible on a removable lock mandrel adapted to be landed and locked in a landing nipple of a well tubing for releasably locking the tool train in operating position in a well bore. The tool train includes a locking probe releasably connectible at a lower end in the locking sub, an adjustable probe mandrel connected with the probe, an equalizing valve and shock absorber, and a gauge for measuring an operating condition in the well connected with the equalizing valve. The locking sub permits insertion of the probe at a relatively low force and requires a substantially larger force for withdrawal of the probe. Additionally, the locking sub grips the probe with a force directly proportional to the pressure differential applied across the locking sub preventing a high pressure below the locking sub from releasing and forcing the tool train up the well bore. The equalizing valve and shock absorber provides for pressure equalization across the tool train during installation and removal and absorbs shock to protect the measuring device.

21 Claims, 15 Drawing Figures

WELL TESTING TOOL SYSTEM

This invention relates to well tools and more particularly relates to a well tool system for isolating lower and upper portions of a well bore and measuring an operating condition within the lower portion of the well bore.

It is frequently necessary to measure operating conditions in well bores such particularly as those through which petroleum oil and gas are produced. Among those conditions which are frequently measured are pressure, temperature, fluid flow velocity, and the like. In testing the well to determine values for such various conditions it is normally necessary to isolate a lower portion of the well bore below the testing tool in which the well operating condition is to be measured. Several different forms of apparatus and method have been available for isolating the portion of the well bore in which the operating condition is to be measured. One form involves the use of a packer in the well bore to engage the wall of the well bore or tubing or casing in the well bore and supported by a string of tubing which must be handled by a drilling or workover rig which involves substantial expense and time. Other forms of available packers for isolating a portion of the well bore are supported upon mechanically operated wirelines or include apparatus which requires support from an electric power line. Each of these latter forms of packers are difficult to operate because of substantial length and very small clearance between the well tubing wall and the packer structure.

One particular use of the system of the invention is in oil fields which have very low or essentially no formation pressure and are to be produced by secondary recovery methods such as water flood in which water is injected into certain wells in the field and forced through the formation toward other producing wells to displace oil to the surface. Studies of such fields must be made to determine the degree of communication, if any, between wells to be employed as injection wells and other wells to be used as producing wells. Such testing includes setting the testing devices in the producing wells and pumping fluids such as water into the injection wells so that pressure determination may be made in the producing wells for evaluating the communication between the wells. Electric line set packers have been used in the past to make such measurements. Such packers generally require a different size for each size of well bore and additionally had no pressure equalizing system. Under such circumstances a sufficient pressure in the well bore below the testing system would blow the packer up the bore when released.

In well tool systems particularly of the wireline supported type where a tool is releasably lockable in a well bore it normally requires a substantial force to insert the tool which can result in application of a shock load to the measuring device in a system such as the present invention. Consequently it is desirable to have a system in which insertion and locking of the measuring device is done with a minimum of force. Where, however, the force required to remove the releasably locked testing system is also minimum it is difficult for the operator at the surface to know when the tool train measuring system is satisfactorily landed and locked in the well bore at the proper operating depth. Consequently it is preferred that a system of the type of the present invention be easy to insert and lock to minimize shock of the testing devices and more difficult to remove in order to provide a positive signal to the operator at the surface that the system has effectively landed and locked.

It is a principal object of the invention to provide a new and improved well testing system.

It is another object of the invention to provide a well testing system of the character described which permits isolation of a well below a desired depth and the measuring of a well operating condition at such depth.

It is another object of the invention to provide a well tool system of the character described which may be landed and locked with a small amount of force and which requires a substantially larger force to release in a well bore.

It is another object of the invention to provide a well tool measuring system which includes shock absorbing means to protect the measuring devices in the system.

It is another object of the invention to provide a well tool testing system of the character described which includes an equalizing valve for equalizing the pressure across the system when installing and removing the system.

It is another object of the invention to provide a well tool measuring system of the character described which includes a locking device adapted to grip more tightly as the pressure differential increases across the device.

It is another object of the invention to provide a well tool testing system of the character described which is useful with a variety of sizes of locking mandrels whereby a single testing system may be used in a variety of wells having different size well bores and tubing strings within such bores.

In accordance with the invention there is provided a well tool testing system which includes a locking sub adapted to be secured with a locking mandrel releasably lockable at a landing nipple in the well bore, and a well testing tool train having a probe which releasably locks in and seals with the locking sub, and adjustable extension connected with the probe, and an equalizing valve and shock absorber connected with the extension for equalizing the pressure across the probe during insertion and withdrawal of the system and to absorb shock for protecting a testing device connected in the tool train. The locking sub, probe, and equalizing valve and shock absorber are provided with a longitudinal continuous flow passage for communicating a well operating condition such as pressure, flow rate, and temperature upwardly through the tool train to the measuring device connected in the tool train. The locking sub and probe are particularly characterized by mechanical features which permit insertion of the probe into the locking sub by use of a low force and requires substantially larger force to withdraw the probe from the sub. Such apparatus includes expandible locking lugs having cam surfaces for expansion and contraction of the lugs aligned at predetermined angles, cam sleeves around the lugs having operating surfaces engageable with the lugs, an annular piston within the cam sleeves supporting the locking lugs for urging the lugs inwardly to more tightly lock the lugs responsive to a pressure differential across the piston, and cam surfaces on the tool train probe engageable with the locking lug cam surfaces and arranged at angles relative to the angles of the cam surfaces on the lugs and cam sleeves for permitting insertion and locking of the probe using a low force and requiring a substantially larger force for withdrawal of the probe. The equalizing valve and shock absorber is a telescoping device adapted to open for flow through the device when extended and closed when telescoped together utilizing spring means for holding the device open until the probe is inserted and locked in the locking sub and reopening for equalizing pressure when extended by a pulling force for withdrawing the tool train from the locking mandrel and locking sub. The equalizing valve and shock absorber includes spring means for absorbing shock upon insertion of the tool train into the locking mandrel and sub and upon withdrawal of the tool train from the locking mandrel and sub. The shock absorbing spring means is arranged to absorb force when extended upon withdrawal and to absorb force when the equalizing valve and shock absorber are telescoped together during withdrawal as a result of a reaction force on the tool train responsive to withdrawal from the locking sub.

The foregoing objects and advantages will be better understood from the following detailed description of a preferred embodiment of the invention taken in conjunction with the accompanying drawings wherein:

FIG. 1 is a longitudinal schematic view partially in section and partially in elevation of a well testing system in accordance with the invention locked at a landing nipple in the tubing string of a well;

FIGS. 2A, 2B, 2C, 2D, and 2E, taken together, form a longitudinal view in section and elevation of the equalizing valve and shock absorber, the adjustable mandrel, the probe, the locking sub, and the locking mandrel of the system of the invention;

Figure 11:
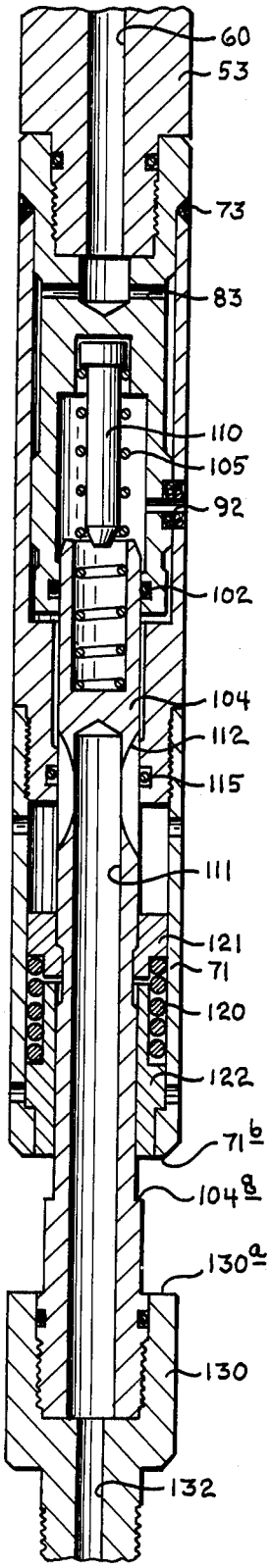
Figure 10:
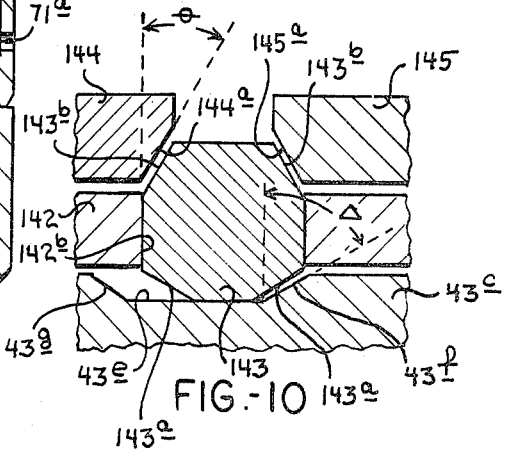

FIG. 10 is an enlarged fragmentary view in section showing one of the locking lugs of the locking sub along with the probe and the annular piston and cam sleeves of the locking sub illustrating the angles between the cam surfaces on the locking lug and on the upper cam sleeve of the locking sub and on the release surface of the probe; and FIG. 11 is a fragmentary longitudinal view in section of the equalizing valve and shock absorber illustrating the operation of the device when pulling upwardly on the tool train such as when checking to see if the train is locked in the well bore and when pulling on the tool train to release the train from the locking sub.

Figure 1:
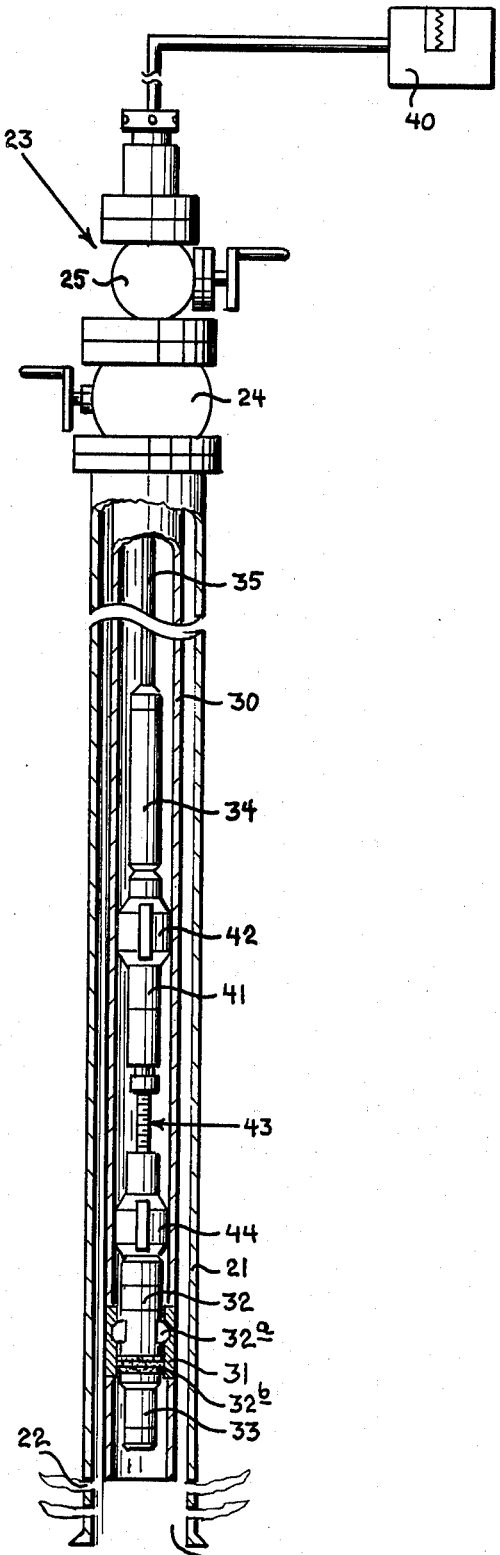

Referring to FIG. 1 of the drawings, a well 20 is shown having a casing 21 perforated at 22 to permit formation fluids to flow into the well through the casing. The casing extends to a wellhead 23 including valves 24 and 25 and supporting a string of tubing 30 extending downwardly in the well bore to a depth in the vicinity of the perforations 22. The tubing string includes a landing nipple 31 in which a lock mandrel 32 is releasably locked. A locking sub 33, in accordance with the invention, is secured on the lower end of the lock mandrel 32. A transducer-type subsurface gauge 34 is supported from a wireline 35 which is preferably an electrical conducting line connected through the wellhead to a recorder 40 at the surface for recording measurements sensed by the gauge. An equalizing valve and shock absorber 41 is connected by a coupling 42 to the gauge 34. An adjustable probe 43 is supported from the equalizing valve and shock absorber 41 and connected through a support assembly 44 adapted to land on the upper end of the lock mandrel 32. A locking probe, not shown in FIG. 1, is supported from the lower end of the adjustable probe 43 and releasably locked within the locking sub 33.

Normally a well completion such as illustrated in FIG. 1 includes the installation of the tubing string 30 with one or more landing nipples 31 included along the length of the tubing string for the subsequent installation of a variety of tools which may be required in the operation of the well. The landing nipple has an internal locking profile which is compatible with the locking dogs on the lock mandrel 32. Typically the lock mandrel 32 may be a Type X Otis Engineering Corporation locking mandrel as illustrated and described at page 3958 of the 1974-75 edition of *The Composite Catalog of Oil Field Equipment and Services*, published by World Oil, Houston, Texas. The lock mandrel 32 includes expandible dogs **32*a* and packing 32*b* as shown in greater detail in FIG. 2D. Other forms of lock mandrels may be employed as required by the particular landing nipple 31 included in the tubing string 30. One of the particular benefits of the present invention is the capability of installing the locking sub 33 on a variety of locking mandrels 32 which in turn may be installed in the landing nipple 31 depending upon the particular character of the landing nipple. Since the locking subs 33 may be installed on a variety of locking mandrels the gauge 34 along with the valve and the shock absorber 42** and the proble assembly supported from the valve and shock absorber may be used in a variety of wells having different tubing size and different landing nipples. Thus the available testing equipment to service a variety of wells is minimized.

Briefly, in the operation of the system of the invention a well originally equipped with the tubing string 30 and the landing nipple 31 is provided in a first step with the locking mandrel 32 on which the locking sub 33 of the invention has been secured. In a subsequent step a tool train including the gauge 34, the equalizing valve and shock absorber 41, and the probe assembly 43 is supported on the wireline 35 which is lowered through the wellhead 23 into the tubing string 30 until the probe assembly is inserted into and locked in the locking sub 33. In accordance with the invention the force required to insert the probe into the locking sub is minimal. During the lowering of the tool train and the insertion of the probe into the locking sub the equalizing valve 41 remains open so that the probe may be inserted into sealed relationship in the locking sub. The shock absorbing feature of the equalizing valve and shock absorber protects the gauge 34 during installation and during pulling of the tool train. The substantially larger force required to pull the locking probe from the locking sub enables the well operator to determine if the tool train is properly locked in operating position. After being properly locked the desired measurements are taken by the gauge 34 and communicated through the cable to the recorder 40 at the surface. While in operation high pressures within the well bore below the locking sub 33 serve only to increase the holding effect of the sub on the locking probe of the tool train. After the tests are completed upward force on the cable 35 releases the tool train from the locking sub. Subsequently if desired the locking mandrel 32 with the locking sub 33 may be retrieved from the well bore in a separate operation.

Figure 2A:
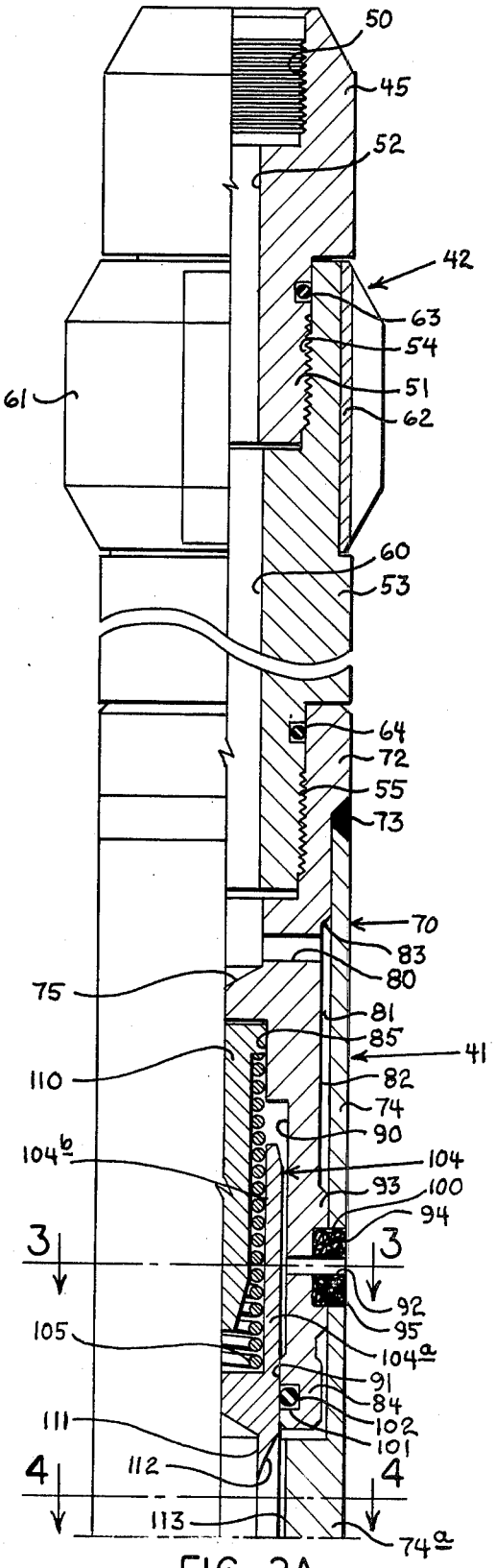
Figure 2B:
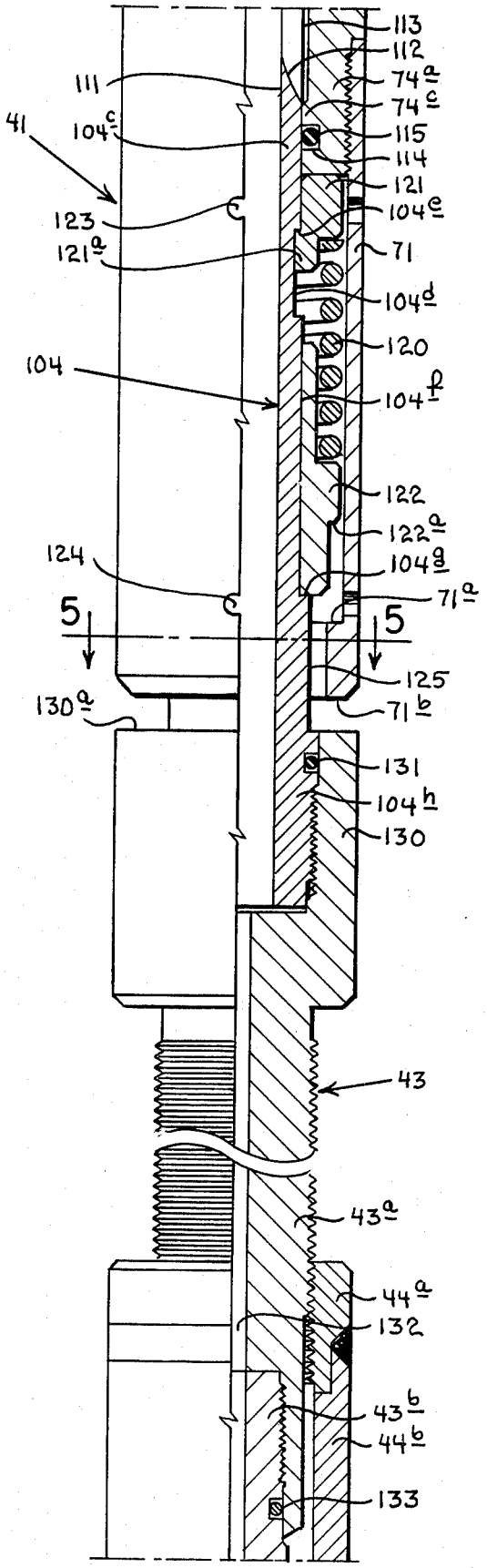

Specific details of the construction of the equalizing valve and shock absorber 41 and the coupling 42 are illustrated in FIGS. 2A and 2B. Referring to FIG. 2A the coupling 42 includes an upper connector 45 having internally threaded upper end portion 50 and a reduced externally threaded lower end portion 51. The connector has a longitudinal bore 52. The connector 45 is threaded into a central section 53 having an upper end portion internally threaded at 54 and an externally threaded lower end portion 55. The central connector 53 has a longitudinal bore 60 communicating with the bore 52 of the upper connector. An enlarged sleeve 61 having circumferentially spaced longitudinal slots 62 is mounted on the connector 53. A ring seal 63 in an external annular recess of the reduced lower end portion 51 of the upper connector seals between the upper connector and the central connector 53. The externally threaded lower end portion 55 of the central connector is secured into the upper end of the equalizing valve and shock absorber. A ring seal 64 in an external annular recess of the connector 53 seals between the coupling 42 and the equalizing valve and shock absorber.

Figure 3:
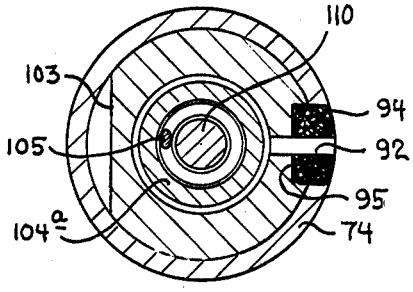
FIG. 3 is a view in section of the equalizing valve and shock absorber taken along the line 3—3 of FIG. 2A.
Figure 4:
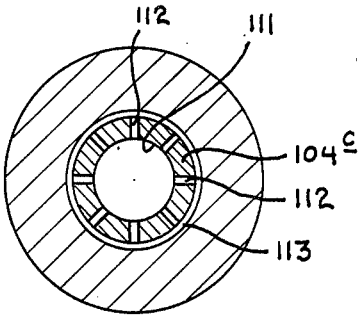
FIG. 4 is a view in section of the equalizing valve and shock absorber taken along the line 4—4 of FIG. 2A.
Figure 5:
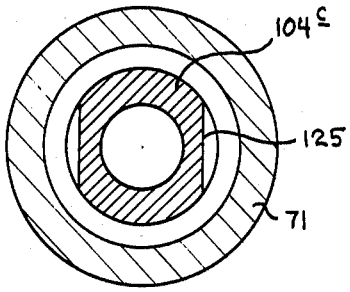
FIG. 5 is a view in section of a lower end portion of the equalizing valve and shock absorber taken along the line 5—5 of FIG. 2B.

The equalizing valve and shock absorber unit 41 is a telescoping device which utilizes various relative longitudinal positions of the telescoping parts for performing valving and shock absorbing functions. The unit 41 has an outer body formed by a crossover head 70 and a sleeve 71. The crossover head includes a valve guide manifold member 72 secured as by welding at 73 with a housing member 74 having an externally threaded reduced lower end portion **74*a* which is secured into the upper end portion of the housing sleeve 71. The upper end portion of the member 72 is internally threaded for securing with the lower threaded end portion of the coupling 42 as shown in FIG. 2A. The upper end of the member 72 has an upwardly opening blind bore 75 which opens upwardly into the bore 60 in the coupling 42 and communicates laterally with a plurality of circumferentially spaced radial ports 80 which open at outer ends into an annular chamber 81 defined between the inner wall surface of the sleeeve 74 and a longitudinal reduced outer wall portion 82 along the member 72. The reduced outer surface portion 82 of the member 72 extends from a tapered shoulder 83 downwardly to a lower end external flange portion 84 of the member 72 which is larger in diameter than the surface portion 82 but sufficiently smaller than the inner wall surface of the sleeve 74 to provide an annular communication path within the sleeve 74 around the lower end portion of the member 72 into the annular space 81 between the sleeve 74 and the member 72. The member 72 has a downwardly opening graduated bore formed by an upper end section 85, a larger intermediate section 90, and a slightly reduced lower end section 91. The bore portion 90 communicates through the side wall of the member 72 and the sleeve 74 along a single side port 92 as illustrated in FIGS. 2A and 3. The port 92 extends through an externally enlarged wall portion 93 of the member 72 and an annular or ring-shaped weld 94 which connects the sleeve 74 and the member 72 together at the enlarged portion 93 of the member 72. This unique structure for connecting the pieces together and providing the lateral port includes an outwardly opening circular recess 95 formed in the outer wall of the enlarged portion 93 of the member 72 and a circular opening 100 in the sleeve 74. In securing the member 72 into the sleeve 74 the member 72 is properly aligned in the sleeve with the recess 95 of the member 72 aligned with the hole 100 of the sleeve 74 after which the spaced defined by the recess 95 and the hole 100 is filled with the weld 94 and thereafter drilled providing the port 92 extending all the way from the outside of the unit into the bore portion 90 of the member 72. The lower flanged end portion 84 of the member 72 has an internal annular recess 101 which contains an O-ring seal 102 for sealing with the valve member of the unit 41. As shown in FIG. 3 the opposite side of the enlarged annular portion 93 of the member 72 is provided with a flat surface 103 which defines with an arcuate portion of the inner wall of the sleeve 74 a longitudinal passage along the member 72 past the enlargement 93 so that fluid flow and pressure may be communicated along the member 72 of the annular space 81 past the enlargement 93**.

Referring to FIGS. 2A, 2B, 3, 4, and 5, a valve and mandrel member 104 is telescopically engaged in the crossover head 70 and housing sleeve 74 for performing both the valving and shock absorbing functions of the unit 41. The member 104 has an upper end portion **104*a* which is slidable within the bore portion 90 of the member 72 and is provided with an upwardly opening blind bore 104*b* which houses a portion of a valve spring 105 for biasing the valve-mandrel member downwardly toward a valve open position. The spring 105 is confined between the bottom face of the bore 104*b* at the bottom end of the spring and an external annular flange on a spring guide 110 telescoped downwardly into the spring 105. The upper end of the spring guide 110 engages the upper end of the bore 85 in the member 72. The sole function of the spring guide is to maintain the alignment of the spring as the spring is compressed and expands during the operation of the unit 41. The ring seal 102 as shown in FIG. 2A seals around the upper end portion of the valve-mandrel member 104 within the lower flanged end 84 of the crossover head member 72. The upper end portion 104*a* of the valve-mandrel member is smaller in diameter than the bore portion 90 of the member 72 to provide an annular space around the valve member upper end portion for free communication to the side port 92 so that as the valve-mandrel member reciprocates during operation of the unit 41 fluid may freely flow into and out of the bore portions 85 and 90 of the member 72. It will be recognized that without the bleed port 92 any fluid confined in the bore portions 85 and 90 would interfere with the operation of the unit. As seen in FIGS. 2A and 2B, the valve-mandrel member 104 has a downwardly opening blind bore 111 which extends throughout the length of a tubular portion 104*c* of the valve-mandrel member 104. The tubular portion 104*c* of the member 104 has a plurality of circumferentially spaced longitudinal arcuate-shaped slots 112 opening into the bore 111. The sleeve 74 is increased in wall thickness along a portion 74*a* which has a longitudinal bore portion 74b slightly larger in diameter than the valve-mandrel member section 104c defining an annular flow passage 113 around the valve member within the sleeve portion 74a generally along the slots 112. As shown in FIG. 2B the sleeve 74 is increased in thickness providing an internal annular flange along a lower end portion 74c which fits tightly around the valve-mandrel section 104c and is provided with an internal annular recess 114 containing a ring seal 115 for sealing between the sleeve 74 and the valve-mandrel member 104. As discussed in more detail hereinafter, the longitudinal position of the slots 112 relative to the ring seal 115 as the valve-mandrel member 104 telescopes during operation of the unit 41 determines whether the valve portion of the unit 41** is open or closed.

Referring to FIG. 2B, a shock absorber spring 120 is disposed around the valve-mandrel section 104c within the sleeve 71 confined between an upper split ring type spring stop 121 and a lower sleeve type spring stop 122. The upper stop 121 comprises two half ring-shaped segments fitted around the tubular portion 104c of the valve-mandrel. The member section 104c has a reduced portion 104d defining an external annular recess in which an internal flange portion 121a of the split ring segments is slidably engaged. A downwardly facing stop shoulder 104e at the upper end of the recess along the portion 104d limits the upward movement of the upper spring guide 121. The lower sleeve type spring guide 122 slides along a slightly enlarged portion 104f of the valve-mandrel section 104c above an upwardly facing lower stop shoulder 104g which limits downward movement of the lower spring stop 122 on the valve-mandrel. The sleeve 71 has a set of circumferentially spaced upper side ports 123 and similar lower ports 124. Below the shoulder 104g the valve-mandrel section 104c is provided with flat surfaces 125 on opposite sides of the valve-mandrel section for engagement by a wrench or other tool used to assemble and disassemble the unit 41. The lower end of the valve-mandrel section 104c is enlarged and externally threaded at 104h for engagement in the upper end of the probe 43 which has an enlarged internally threaded upper end portion 130. A ring seal 131 in an external annular recess of the lower end portion of the valve-mandrel 104 seals between the valve-mandrel and the end portion 130 of the probe to prevent leakage between the two members as the desired data such as pressure must be communicated upwardly through the probe and the valve-mandrel members.

Figure 2C:
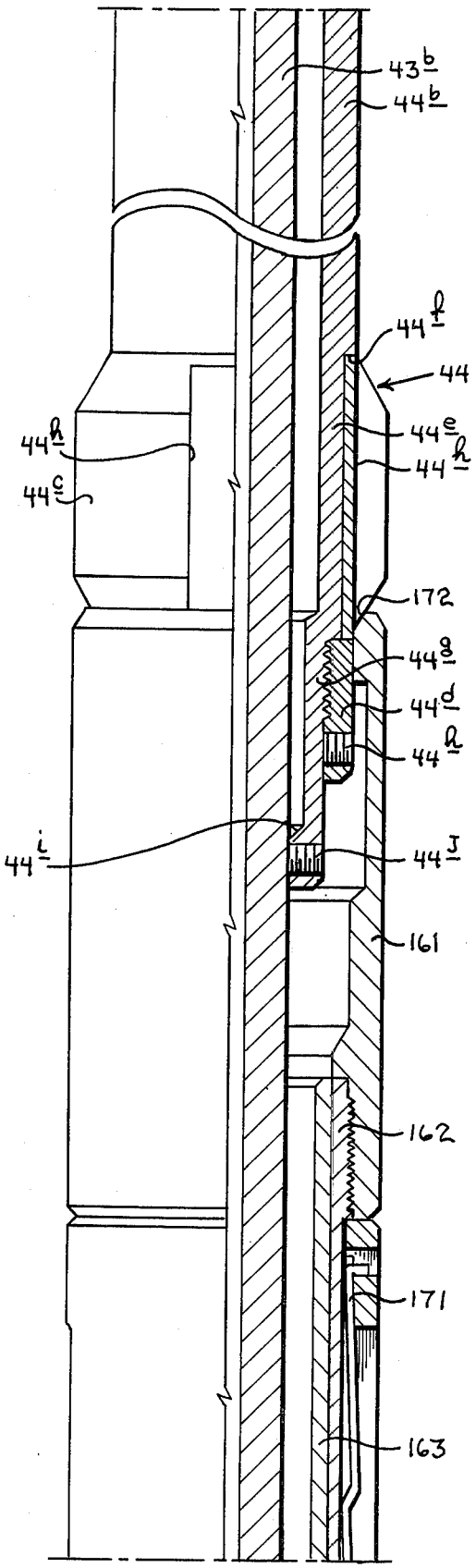
Figure 2D:
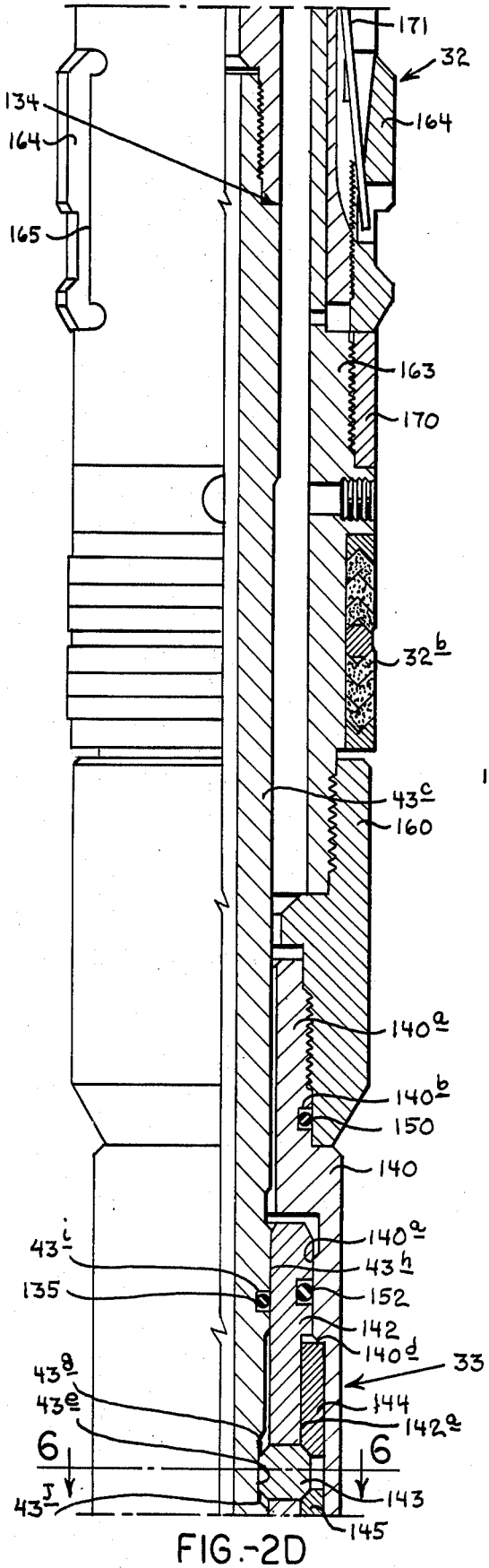

Referring to FIGS. 2B, 2C, 2D, and 2E, the probe assembly 43 has an upper externally threaded section 43a, a long central section 43b, and a lower locking section 43c. Each of the sections of the probe assembly is tubular in shape defining a flow passage 132 which extends the full length of the assembly to communicate fluid pressure and the like from below the probe upwardly into the equalizing valve and shock absorber unit 41. The several sections of the probe assembly are secured together by threaded connections as seen in FIGS. 2B and 2D. A ring seal 133 in an external annular recess of the probe section 43b seals between the probe sec-43b and the section 43a. The threaded connection between the probe assembly sections 43b and 43c as shown in FIG. 2D is welded at 134 to provide a permanent fluid tight connection. As explained in greater detail hereinafter, the threaded section 43a permits the probe assembly to be accommodated to different lock mandrels by adjustment of the longitudinal position of the lower locking end section of the probe assembly.

Referring to FIGS. 2B and 2C the landing sleeve assembly 44 which supports the tool train on the locking mandrel 32 is connected with the threaded probe section 43a so that the relative position of the probe assembly 43 is adjustable in the landing sleeve assembly. The landing sleeve assembly includes an internally threaded ring-shaped head member 44a welded into an elongated sleeve 44b, a no-go type support ring 44c mounted on the sleeve 44b, and a retainer ring 44d for holding the ring 44c on the sleeve. The ring 44c is on a reduced portion 44e of the sleeve 44b providing a downwardly facing stop shoulder 44f holding the ring 44c against upward movement on the sleeve. The retainer ring 44d is threaded on a still further reduced section 44g of the sleeve 44b. The ring 44d has a threaded hole 44h for a set screw, not shown, for locking the ring 44d in place on the reduced sleeve section 44g. The sleeve 44b along the lower end portion of the sleeve has an internal flange 44i forming a close fit with the probe assembly section 43b to cooperate with the threaded connection between the support sleeve assembly 44 and the probe assembly at the ring 44a for properly maintaining the alignment of the probe assembly through the landing sleeve assembly. The flanged section 44i of the sleeve 44b has a threaded hole 44j for a set screw for locking the sleeve 44b with the probe assembly section 43b at the flange 44i. The no-go ring 44c has circumferentially spaced longitudinal slots 44k which permit fluid flow along the ring 44c as the tool string is raised and lowered in the tubing string of a well bore.

Figure 2E:
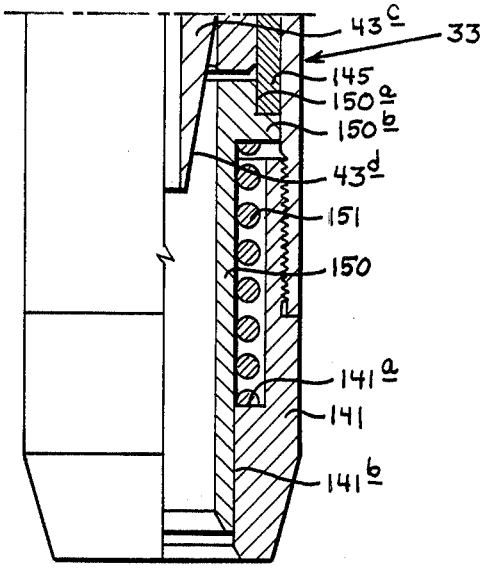

Referring to FIGS. 2D and 2E, the lower end locking section 43c of the probe assembly is configured for releasable locking in the locking sub 33 responsive to a low downward force on the probe assembly and releasable upon application of a substantially larger upward force on the probe assembly. The probe assembly section 43c has a tapered lower end portion defined by a downwardly and inwardly convergent entry cam surface 43d which slopes at a very low angle such as about 10 degrees with the longitudinal axis of the probe section so that the cam surface will exert a substantial lateral force perpendicular to the longitudinal axis of the probe section responsive to a relatively low downward force on the probe. For example, in one prototype of the invention a downward force of 15 pounds on the probe applies a lateral force of 86 pounds for operating the locking sub 33. Above the entry cam surface 43d as shown in FIG. 2D the probe section 43C has an external annular locking recess 43e defined between a lower cam surface 43f and an upper cam surface 43g. The lower cam surface 43f is the release cam surface of the probe and the angle of the cam surface is critical to the operation of the probe concerning the force required for pulling the probe upwardly out of the locking sub 33, for example. As contrasted with a low entry force for the probe of amount 15 pounds it is preferred that the upward release force on the probe be in the neighborhood of 200 pounds. Further details of this feature of the invention are discussed hereinafter. Above the locking recess 43e, the probe section 43c has an external annular boss 43h provided with an external annular recess 43i which contains a ring seal 135 for sealing with the bore through the locking sub 33 so that fluid is limited to the bore through the probe assembly when the probe assembly is properly seated and locked with the locking sub.

Figure 9:
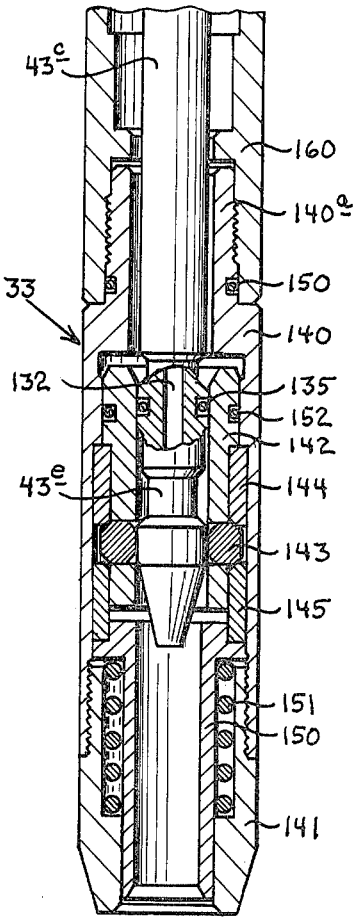
FIG. 9 is a fragmentary view in section of the lower portion of the probe and the locking sub with the lugs of the locking sub expanded as when the probe is being inserted into the locking sub and when the probe is released from and being withdrawn from the sub.

Referring to FIGS. 2D, 2E, and 9, the locking sub 33 includes a tubular housing 140, a bottom sub 141, an annular piston 142, a plurality of circumferentially spaced locking lugs 143, upper and lower locking cam sleeves 144 and 145, a tubular operator member 150, and an operator member spring 151. As shown in FIG. 2D the housing 140 has a reduced threaded upper end portion 140*a* which engages the lower end of the lock mandrel 32 for supporting the locking sub 33 from the lock mandrel 32. A ring seal 150 in an external annular recess 140*b* of the housing 140 seals between the locking sub housing and the housing of the lock mandrel. The piston 142 fits within an enlarged bore portion of the housing 140 which has an internal annular seal surface 140*a* which permits a sliding seal with the upper external wall surface of the piston 142. A ring seal 152 in an external annular recess along the upper end portion of the piston 142 provides a fluid tight sliding seal between the piston and the seal surface 140*a* of the housing. The upper cam sleeve 144 forms a sliding fit with a reduced portion 142*a* of the piston 142. The upper end edge of the sleeve 144 engages a downwardly facing internal stop shoulder 140*d* which prevents upward movement of the sleeve 144 in the housing. The lower cam sleeve 145 also forms a sliding fit with the reduced portion 142*a* of the piston 142 below the locking lugs 143. The lower sleeve 145 also is slidable in the housing 140 and is seated along a lower end portion in an external annular recess 150*a* against an upper face of an external annular flange 150*b* of the operator member 150 so that the sleeve 145 and the operator member 150 move upwardly and downwardly together during the locking and releasing of the probe assembly in the locking sub. The spring 151 is confined between the bottom face of the flange 150*b* at the upper end of the spring and an internal annular stop shoulder 141*a* within the bottom sub 141 at the bottom end of the spring so that the spring biases the operator member 150 upwardly. The lower end portion of the operator member 150 is slidable in a reduced lower end portion 141*b* of the bottom sub 141.

Figure 6:
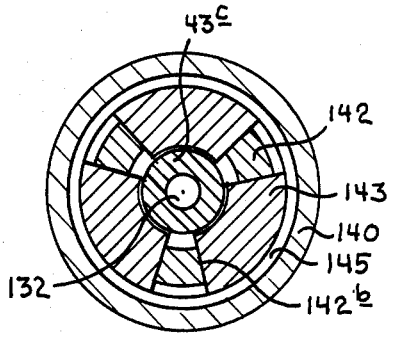
FIG. 6 is a view in section of the probe and locking sub taken along the line 6—6 of FIG. 2D.

Referring to FIGS. 2D and 6, the locking lugs 143 are each a 90 degree arcuate segment member slidably positioned in a window 142*b* of the annular piston 142. As seen in FIG. 6 three of the 90 degree locking lug segments are provided disposed circumferentially through three windows 142*b* provided in the annular piston. The side walls of the lugs are inwardly convergent as are the side walls of the windows in which the lugs slide. The top and bottom faces of the lugs are parallel with each other and perpendicular to the vertical axis of the lugs. The top and bottom faces of the windows 142*b* as evident in FIG. 2D are parallel with each other and perpendicular to the longitudinal axis of the piston 142. The lugs are tightly but slidably fitted in the windows whereby the lugs may move inwardly and outwardly laterally or radially but may not move vertically or longitudinally relative to the piston 142. The lugs and the piston must move vertically together.

FIG. 10 shows a single one of the lugs 143 with fragments of the supporting annular piston 142, the upper and lower cam sleeves 144 and 145 and the locking section 43*c* of the probe assembly in the vicinity of the locking recess 43*e* of the probe section. It will be recognized that FIG. 10 for purposes of discussion and illustration has been rotated 90 degrees counterclockwise from the actual operating position of the parts illustrated which would normally be in a vertical well position as shown in FIGS. 2D and 2E as well as FIG. 9. Each of the locking lugs 143 has internal tapered cam surfaces 143*a* which are circular segments geometrically being a segment of a conical surface sloping toward each other. Similarly, each of the lugs 143 has external arcuate cam surfaces 143*b* which slope outwardly and toward each other on the lug. Similarly, each of the upper and lower cam sleeves 144 and 145 is provided with a sloping internal annular cam surface. The sleeve 144 has a cam surface 144*a* which is engageable with the upper locking lug cam surface 144*b*. The lower cam sleeve 145 has a cam surface 145*a* engageable with the lower locking lug cam surface 143*b*. Generally, internal lug cam surfaces 143*a* are aligned at the same angles which correspond with the angles of the probe cam surfaces 43*f* and 43*g*. Also, the outer lug cam surfaces 143*b* are aligned at the same angles which correspond with the angles of the sleeve cam surfaces 144*a* and 145*a*. A particularly important aspect of the invention is the relationship between the angles of the probe and lug cam surfaces 43*f* and 143*a* represented by the angle $\Delta$ and the angle of the lug and sleeve cam surfaces 143*b* and 144*a* represented by the angle $\theta$. The relationship between the angle $\Delta$ and the angle $\theta$ must allow removal of the probe from a locked position within the locking lugs which means that when the probe is pulled upwardly, to the left in FIG. 10, the cam surface 43*f* on the probe must force the lugs 43 outwardly with the lug cam surface 143*b* sliding outwardly and downwardly along the sleeve cam surface 144*a*. The angle $\Delta$ must exceed the angle $\theta$ by a predetermined value, taking into consideration the friction angle of the materials involved, to avoid jamming of the probe within the locking lugs such that it will not cam the lugs outwardly and thus cannot be withdrawn from the locking sub. The angle of friction between lubricated contacting hard steel surfaces is, for example, about 10–12 degrees. The angles $\theta$ and $\Delta$ as represented in FIG. 10 are determined as follows. The angle $\theta$ is equal to the value of a preselected angle minus a friction angle. The angle $\Delta$ is equal to a preselected angle plus the friction angle. The values of the preselected angles are engineering considerations based upon the forces desired for insertion and removal of the probe. Typically it has been found that the angle $\Delta$ should exceed the angle $\theta$ by approximately 30 degrees. In one operable prototype of the device of the invention the angle of the inner lug cam surfaces 143*a* measured in the same manner as the angle $\Delta$ was set at 55 degrees while the angle of the outer lug cam surfaces 143*b* measured in the manner of the angle $\theta$ was set at 25 degrees to produce a probe withdrawal force required for release of the probe at approximately 200 pounds. It will be apparent that while the angle $\Delta$ may not be decreased to a value below a predetermined value which exceeds the angle $\theta$ by the required differential, any increase of the angle $\Delta$ in excess of the necessary minimum will reduce the magnitude of the force required to pull the probe out of the locking sub. Other factors to be described also affect the value of the force required for release of the probe. Other factors which affect the force required to insert and withdraw the probe include the force required to compress the spring 151. It will be recognized that since the cam sleeve 144 cannot move upwardly and for the probe to enter or withdraw from the locking sub, the lugs 143 must move radially outwardly and the only way that the lugs can move outwardly is for the lower cam sleeve 145 to move downwardly against the spring 151. Thus, when the probe is entering the locking sub and when the probe is being withdrawn from the sub the cam surfaces on the probe force the locking lugs outwardly causing the upper outer cam surfaces 143*b* on the lugs to slide outwardly and downwardly along the cam surface 144*a* of the upper cam sleeve 144. The outward downward movement of the lugs carries the annular piston 142 downwardly and forces the lower cam sleeve 145 downwardly moving the operating member 150 downwardly compressing the spring 151. Opposing the upward force of the spring 151, during insertion of the probe a downward force of the probe cam surface 43*g* against the locking lug upper cam surfaces 143*a* has a downward component which is transmitted through the lugs 143 to compress the sleeve 145 downwardly and at the same time produces a radial force expanding the lugs 143 against the upper sleeve cam surface 143*a* and as the lugs move outwardly that also tends to depress the cam sleeve 145. A somewhat different condition exists upon withdrawal of the probe when the upward component of the force on the lugs 143 applied to the lower inner cam surfaces 143*a* is resisted by the upper cam sleeve 144 while the horizontal component of the forces applied to the lugs 143 again expands the lugs forcing them outwardly and downwardly along the cam surface 144*a* again depressing the cam sleeve 145. It will be recognized that the reaction force against the lugs at the upper cam sleeve during withdrawal of the probe specially accommodates the design of the invention to the desired substantially larger force requirement for probe withdrawal.

A particularly important feature of the locking sub 33 is that as the fluid pressure differential across the annular piston 142 of the sub increases with the higher pressure existing within the tubing string below the seal 32*b*, the locking sub grips the probe more securely preventing the higher pressure from blowing the probe upwardly out of the locking sub. The annular piston 142 has limited longitudinal upward movement within the housing 140. The locking lugs 143 are fitted for radial movement only within the windows of the annular piston. The upper cam sleeve 144 cannot move upwardly due to the stop shoulder 140*d*. Thus, a higher fluid pressure applied across the annular area defined between the line of sealing of the ring seal 135 with the inner wall of the piston 142 and the line of sealing of the ring seal 152 with the seal surface 140*a* of the housing 140 urges the annular piston 142 upwardly. The upward force tends to carry the locking lugs 143 upwardly with the annular piston 142 so that the upper outer cam surfaces 143*b* on the lugs are urged against the lower cam surface 144*a* on the cam sleeve 144 forcing the lugs inwardly more tightly against the probe section 143*c* in the locking recess 43*e* of the probe section. As the pressure differential across the annular piston 142 increases the grip of the lugs on the probe increases.

The locking sub 33 is secured on the lock mandrel 32 by a coupling 160 which threads on the lock mandrel below the packing assembly 32*d*. As previously mentioned the lock mandrel 32 is a standard available Otis Engineering Corporation Type X Locking Mandrel. The mandrel has an upper tubulur fishing neck 161 secured along a lower end portion with a slidable expander mandrel 162 which is mounted on a body mandrel 163 as shown in FIGS. 2C and 2D. The body mandrel 163 connects with the coupling 160 and supports the packing 32*b*. A plurality of radially expandible locking dogs 164 are mounted in windows 165 of a locking dog retainer sleeve 170 mounted on the body mandrel. Each of the locking dogs is biased outwardly by a spring 171. The locking dogs 164 are expanded and locked outwardly by downward movement of the expander mandrel responsive to a downward force on the fishing neck. An upward pull on the fishing neck lifts the expander mandrel to release the locking dogs when the locking mandrel is to be removed from a landing nipple. The upper end of the fishing neck has an internal downwardly and inwardly tapered support shoulder 172 on which the no-go ring 44*c* of the landing sleeve assembly 44 rests when the probe assembly is inserted into and locked with the locking sub 33. A particular benefit of the threaded adjustable section of the probe assembly 43 is the capability of adjusting the distance between the no-go ring 44*c* and the lower locking section of the probe compatible with the distance between the landing shoulder 172 on the fishing neck 161 and the locking lugs 143 in the locking sub 33 connected on the lower end of the lock mandrel.

In a typical prototype of the invention the locking sub 33 utilized a 25 degree angle for the outer lug cam surfaces 143*b* as previously discussed, a 55 degree angle for the inner lug cam surfaces 143*a* with corresponding angles on the probe and the cam sleeves along with a spring 151 which applied approximately a 75 pound load on the operator 150. Such a locking sub required a 15 pound downward force on the probe assembly 43 to insert the probe to a locking position and a 200 pound upward force to retrieve the probe. In the same prototype the equalizing valve and shock absorber unit 41 employed a spring 105 which required a 25 pound force to compress the spring for closing the equalizing valve and utilized a shock absorber spring 120 requiring a 150 pound force for full compression during the shock absorbing function of the unit 41.

The first step in the operation of the system of the invention in a well fitted with the tubing string 30 and the landing nipple 31 is the connection of the locking sub 33 on the lower end of a lock mandrel 32 in the relationship as shown in detail in FIGS. 2D and 2E, and the landing and locking of the lock mandrel 32 in the landing nipple 31 in the tubing string. This procedure is carried out in the usual standard steps involving the engagement of a wireline handling tool with the fishing neck 161 of the lock mandrel 32. The wireline handling apparatus and the technique of operating the apparatus are well known and comprise no part of the present invention. The particular lock mandrel 32 selected is compatible with the landing nipple 31 in having locking dogs 32*a* which have landing and locking profiles matching the internal profile of the landing nipple. One of the particular features of the invention is the adaptability of the locking sub 33 to various designs and sizes of lock mandrels 32 in that by selection of the proper coupling 160 as shown in FIG. 2D the locking sub is attachable to any desired size and design of lock mandrel 32.

Figure 7:
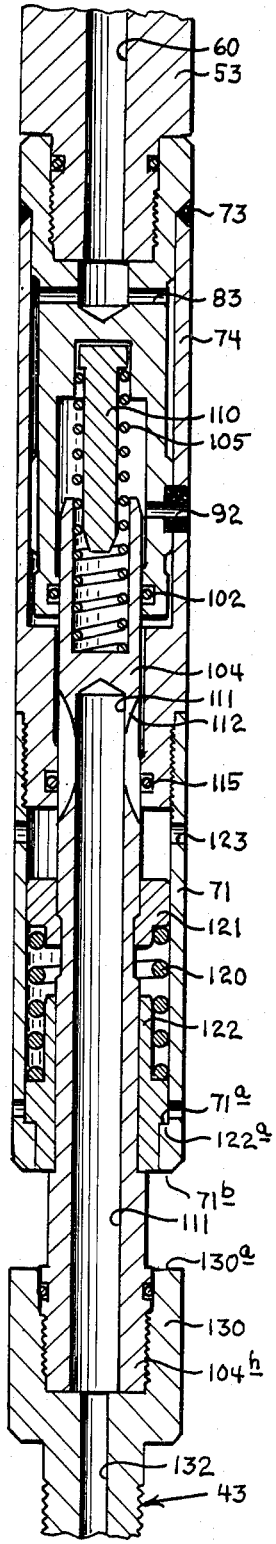
FIG. 7 is a fragmentary longitudinal view in section of the equalizing valve and shock absorber extended with the equalizing valve open during lowering the tool train in a well bore and during the initial step of pulling the train from locked condition from the locking sub.

After the installation of the lock mandrel 32 the tool string including the measuring device 34, the coupling 42, the equalizing valve and shock absorber unit 41, the probe assembly 43, and the probe assembly landing sleeve 44 are attached together and lowered with the usual wireline apparatus into the well tubing string 30 on the electric wireline 35. During the lowering of the tool string the equalizing valve and shock absorber unit 41 extends to open the equalizing valve portion of the unit as illustrated in FIG. 7. The weight of the probe assembly 43 along with the associated connected parts including the valve-mandrel 104 of the unit 41 coupled with the force of the valve spring 105 telescopes the valve-mandrel 104 to a lower end position within the crossover head 70 and sleeve 71 of the unit 41 as illustrated in FIG. 7. The valve-mandrel telescopes downwardly until the stop shoulder 122*a* on the member 122 engages the internal annular stop shoulder 71*a* within the internally flanged lower end portion of the sleeve 71. At the lower end open poition of the valve-mandrel communication is provided from the bore 111 radially outwardly through the slots 112 and downwardly within the slots past the lower ring seal 115 into the sleeve 71 below the lower end of the member 74 above the split ring spring retainer 121 and outwardly through the side ports 123. The lower end of the bore 111 communicates with the bore 132 of the probe assembly 43 which extends through the lower end of the probe assembly so that fluid bypass is provided from below the probe assembly through the entire length of the assembly and valve-mandrel member outwardly through the side ports of the unit 141 which materially aids in the lowering of the tool string and permits the probe assembly to be stabbed into a sealed locked relationship within the locking sub 33 as shown in FIGS. 2D and 2E. When the valve-mandrel 104 telescopes downwardly the side port 92 of the unit 41 permits inward fluid flow into the chamber around the upper end portion of the member defined by the bores 85 and 90 within the crossover head 70. The equalizing valve and shock absorber unit 41 remains open as illustrated in FIG. 7 until the probe assembly is fully inserted into and locked with the locking sub 33 because the spring 105 requires 25 pounds for compression of the spring while the probe assembly locking tip requires only 15 pounds for insertion to the fully locked position represented n FIGS. 2D and 2E. The locking tip of the probe assembly is lowered through the bore of the lock mandrel 32 into the bore of the locking sub 33 within the lugs 143 of the locking sub. The tapered cam surface 43*d* along the lower end portion of the probe engages the inside faces of the lugs 143 camming the lugs outwardly as shown in FIG. 9 to expanded positions which permits the probe to pass downwardly until the lugs 143 are aligned with the locking recess 43*e* on the probe. The outward expansion of the lugs 143 as evident from FIG. 10 causes the lug cam surfaces 143*b* to slide outwardly along the cam surfaces 144*a* and 145*a* of the cam sleeves 144 and 145 respectively. It will be evident that for the lugs to move outwardly between the sleeves 144 and 145 the lower sleeve 145 must move downwardly against the spring 151 since the upper sleeve 144 is limited by the shoulder 140*d* against upward movement. The operator member 150 supporting the sleeve 145 is depressed sufficiently downwardly compressing the spring 151 to allow the full outward expansion of the lugs 143 for the probe locking tip to pass within the lugs until the recess 43*e* on the locking tip is aligned with the lugs. The force of the spring 151 acting upwardly on the operator member 150 lifts the cam sleeve 145 toward the upper sleeve 144 squeezing the lugs 143 back inwardly to the locking positions represented in FIGS. 2D and 10.

Figure 8:
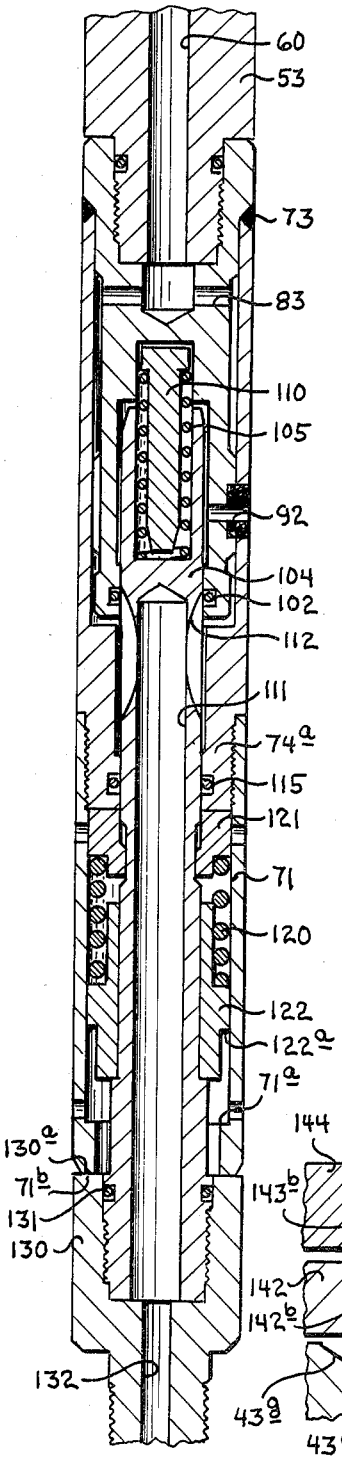
FIG. 8 is a fragmentary longitudinal view in section of the equalizing valve and shock absorber telescoped together as when the tool train initially lands and locks in the locking sub and when the tool train is pulled and released causing a reaction force to compress the device together.

During a normal installation of the system of the invention the shock absorbing features of the equalizing valve and shock absorber unit 41 will not function. If, however, a larger than normal downward force is applied to the system which could occur for example as a reaction to lowering the tool string too fast causing it to strike the lock mandrel at a velocity which would telescope the tools including the gauge 34 and the coupling 42 downwardly. In such event the crossover head 70 along with the sleeve 71 move downwardly while the probe assembly 43 including the valve-mandrel member 104 which is secured with the probe assembly are held against downward movement by the engagement of the landing ring 44*c* on the lock mandrel shoulder 172 as seen in FIG. 2C. The cross head and sleeve of the unit 41 move downwardly until the lower end edge 71*b* of the sleeve engages the upper end edge 130*a* on the head end of the probe assembly section 43*a*. As the cross head and sleeve move downwardly the lower end edge of the member 74*a* forces the split ring segments 121 downwardly against the shock absorber spring 120. The split ring segments move downwardly along the recess 104*d* on the valve-mandrel 104 as shown in FIG. 8. The shock absorber spring thus absorbs impact loading to protect the gauge 34 from shock damage.

A principal reason for providing the substantial load requirement for disengaging the probe assembly from the locking sub 33 is to enable the operator of the system to be assured that the probe assembly is properly locked before taking further steps which would place a pressure differential across the system that might blow it back up the well. The substantially larger force such as the 200 pounds previously discussed required to disengage the probe permits the operator to place enough upward load on the wireline which can be measured at the surface to know that the probe is properly locked. When such upward load is applied to the wireline the unit 41 will be telescoped to an extended condition which may range from that shown in FIG. 7 to that of FIG. 11 in which the shock absorber spring 120 is compressed upwardly. Of course, if the upward force applied to check the probe is less than that required to compress the shock absorber spring, the system will telescope to the condition of FIG. 7.

After the system is properly landed and locked as described, the desired measurements may be made with the gauge 34. For example, if pressure testing of a well to be used as a producing well in a secondary recovery operation is the objective the pressure in the formation is raised at the injection well or wells with the measurements then being taken with the system of the invention at the producing well in which the system is installed. The pressure within the well bore is applied upwardly through the bore 132 of the probe assembly 43, through the bore 111 of the equalizing valve and shock absorber unit 41, outwardly through the radial slots 112 into the annular space 113 between the valve-mandrel 104 and the member 74. The pressure is communicated upwardly in the annular space 113 into the annular space 81 in the cross head 70 along the flat surface 103 as shown in FIG. 3 and upwardly continuing along the annular space 81 into the side ports 80 to the bore 60 in the coupling 42 through which the pressure is communicated to the gauge 34. Such communication is made possible by the fact that the equalizing valve is closed when the weight of the tool string is placed on the unit 41 after completion of the locking of the probe assembly in the locking sub. The weight of the tool string above the unit 41 is sufficient to compress the spring 105 returning the equalizing valve and shock absorber unit to the condition represented in FIGS. 2A and 2B at which the valve slots 112 are longitudinally between the upper ring seal 102 and lower ring seal 115 thereby confining the pressure communication to the annular space 113 from which it is communicated upwardly as described.

As previously discussed in detail in connection with the description of the locking sub 33, a pressure differential across the annular piston 142 of the locking sub urges the piston and the locking lugs 143 upwardly applying a radially inwardly acting force on all of the lugs due to the coaction between the upper cam sleeve surface 144*a* and the upper outer locking lug cam surfaces 143*b*. The greater the pressure differential the more tightly the locking sub grips the probe assembly. Thus, while the probe may be released from the locking sub by a force on the order of about 200 pounds depending upon probe and locking sub design, a well pressure below the locking sub may apply substantially higher pressures across the sub and locked probe without dislodging and forcing the probe upwardly due to the fact that the gripping of the locking sub with the probe increases in direct relation to the increase in the pressure differential across the members.

When the desired measurements have been taken by the gauge 34 and recorded if desired by the recording unit 40 at the surface, the system of the invention may be removed from the well bore. An upward force is applied at the wellhead to the wireline 35 which lifts the gauge 34, the coupling 42, and the crossover head 70 and sleeve 71 of the equalizing valve and shock absorber 41. With the probe assembly 42 and the valve-mandrel 104 of the unit 41 being held against upward movement due to the locking of the probe assembly with the locking sub 33 the unit 41 is telescoped initially to the condition shown in FIG. 7. The sleeve shoulder 71*a* then engages the shoulder 122*a* on the shock absorber operator member 122 lifting the member upwardly comprising the shock absorber spring 120 toward the split ring segments 121 at the upper end of the spring which cannot move upwardly on the member 104 due to engagement with the stop shoulder 104*e*. FIG. 11 represents the relative position of the parts of the unit 41 after the shock absorber spring has compressed substantially. The operator member 122 is lifted against the shock absorber spring until the upper end edge of the member engages the lower end edge of the split ring segments 121 picking up the valve-mandrel member 104 thereby applying the upward force to the probe assembly 43. When the force exceeds the required value, such as 200 pounds in one form of the device as discussed, the locking end of the lower probe section cams the locking lugs 143 outwardly to the positions shown in FIG. 9 releasing the probe. It will be seen both in FIG. 7 and in FIG. 11 that throughout the pulling of the probe the valve-mandrel 104 is at an open position thereby communicating the central bore of the probe with the side ports 123 equalizing the pressure across the probe as it is pulled from the sealed locked relationship in the locking sub 33. In applying the upward pulling force to the tool string after overcoming the locking and frictional resistance to upward movement of the probe, the probe tends to snap upwardly shifting the valve-mandrel member upwardly against both the valve spring 105 and the shock absorber spring 120 until the unit 41 telescopes together as shown in FIG. 8 limited by the engagement of the shoulder 130*a* on the upper end of the probe assembly with the downwardly facing shoulder 71*b* on the sleeve 71 of the equalizing valve and shock absorber unit. The energy absorption characteristic of both springs thereby protects the gauge 34 from shock damage due to this reaction force when the probe assembly snaps upwardly. Thereafter the weight of the probe assembly and connected parts pulls the probe assembly and parts back downwardly to the positions shown in FIG. 7 at which the equalizing valve is open as the tool string is pulled upwardly in the well bore. Throughout the telescoping action of unit 41 the side port 92 in the unit 41 allows fluid to flow into and out of the bore spaces around the upper end of the valve-mandrel 104. Thus any fluid in the bore spaces when the valve-mandrel moves upwardly is expelled through the port 92.

Subsequent to the removal of the tool string down through and including the probe assembly 43 from the lock mandrel 32, the lock mandrel with the connected locking sub 33 may be retrieved from the landing nipple 31 using standard wireline apparatus and procedures for engaging the lock mandrel at the fishing neck 161 to release the lock mandrel by pulling upwardly on the fishing neck allowing the keys 164 to contract inwardly. Removal of the lock mandrel 32 restores the well to the original condition.

While the system of the invention including the gauge 34 have been described in terms of pressure measurement, it will be recognized that such other well operating conditions may be measured as fluid flow rate by using a gauge which allows fluid flow back into the tubing string 30 above the gauge and on to the surface in the tubing string.

It will now be seen that a new and improved system of well tools has been described and illustrated which may be readily installed in existing wells for measuring well characteristics. The system includes an equalizing valve and shock absorber operable responsive only to longitudinal telescoping action for both equalizing pressure across a seal established by the tool string in the well bore and for absorbing shock encountered during the installation and retrieval of the tool string to protect the measuring equipment included in the string. The system also includes locking means which is operable by a small entry force and requires a substantially larger withdrawal force which provides ready means for determining if the tool string is properly locked in a well bore. The locking system also is adapted to grip more tightly as the pressure differential increases across the system in the well bore. The use of the separate locking sub securable to the lock mandrel allows the system to be employed in different sized tubing strings and locking mandrels since the seal effected by the locking sub for isolating the lower portion of a well is made with the locking sub which is attachable to a variety of types and sizes of lock mandrels.

What is claimed is:

1. A tool system for use in a well bore having a tubing string including a landing nipple forming a part thereof, comprising: a locking sub adapted to connect on a lock mandrel set in said landing nipple; and a tool train for releasably engaging said locking sub and sealing therewith to isolate said well bore below said locking sub, said tool train including a locking probe releasably engageable with said sub, said probe having seal means for engaging a seal surface in said sub and a longitudinal bore defining a flow passage from below said seal means to an upper end of said probe, and means for connecting said probe and communicating said probe bore with means for measuring a well condition communicated through said probe bore; said locking sub and said locking probe including means for releasably locking said probe in said sub responsive to a first force of a predetermined value and for releasing said probe from said sub responsive to a second force of a greater predetermined value.

2. A tool system in accordance with claim 1 wherein said locking sub includes means for holding said locking probe with a force proportional to a pressure differential across the seal between said locking probe and said locking sub.

3. A tool system in accordance with claim 1 wherein said tool train includes an equalizing valve for communicating said probe bore above said seal with a well bore around said tool string during running and pulling of said tool string.

4. A tool system in accordance with claim 3 wherein said tool train includes a shock absorber for absorbing impact forces applied to said tool train during running and pulling of said train.

5. A tool system in accordance with claim 1 wherein said tool train includes an equalizing valve for communicating said probe bore with said well bore around said tool train during running and pulling of said tool train.

6. A tool system in accordance with claim 5 wherein said tool train includes a shock absorber for absorbing impact forces on said tool train during running and pulling of said train.

7. A tool system in accordance with claim 2 wherein said tool train includes an equalizing valve for communicating said probe bore with said well bore above said seal means on said locking probe during running and pulling of said tool train.

8. A tool system in accordance with claim 7 wherein said tool train includes a shock absorber for absorbing impact forces on said tool train during running and pulling of said train.

9. A well tool system for use in a well bore and having a tubing string including a landing nipple forming a part thereof and a lock mandrel in said landing nipple, said system comprising: a locking sub having a central longitudinal bore therethrough and a housing connectible on said lock mandrel, locking lugs in said housing radially movable between inward locking positions extending into said bore and outward release positions out of said bore, means connected with said lugs for urging said lugs inwardly toward said first locking positions responsive to a pressure differential applied between defined locations in said bore; and a locking probe insertable into said locking sub, said locking probe having longitudinally spaced operating surfaces including a first cam entry surface for expanding said lugs upon insertion of said probe into said bore of said sub, a locking recess for receiving said lugs when said lugs are in said first inward locking position to hold said probe against longitudinal movement within said bore, and a cam release surface defining one end of said locking recess, said cam release surface sloping at a greater angle with the longitudinal axis of said probe than said cam entry surface whereby greater force is required to withdraw said probe from said bore of said sub than the force required to insert said probe into said bore of said sub.

10. A well tool system in accordance with claim 9 wherein said probe is provided with a longitudinal bore defining a flow passage therethrough, seal means on said probe to seal in said bore of said locking sub, and an equalizing valve connected with said probe including a pressure release port communicated with said probe bore during running and pulling of said probe.

11. A well tool system in accordance with claim 10 including shock absorber means connected with said probe for absorbing impact forces applied to said probe during running and pulling of said probe.

12. A well tool system in accordance with claim 11 wherein said equalizing valve is a telescoping structure having a tubular central member slidably fitted within an outer tubular housing member, said pressure release port being provided in said outer housing member, and said members having cooperating flow passage means opening said pressure release port to said probe bore when said central member and said housing member are telescoped apart to first extended positions and closing said pressure release port when said central member and said housing member are telescoped together.

13. A well tool system in accordance with claim 12 wherein said shock absorber means comprises a spring disposed between said central member and said housing member and annular spring stops between said members at opposite ends of said spring for compressing said spring responsive to movement of either of said members toward the other of said members.

14. A well tool system in accordance with claim 13 including well operating condition measuring means connected with said equalizing valve for measuring a well condition communicated through said valve to said measuring means and means connecting said measuring means with a wireline for running and pulling said well tool system in a well bore.

15. A tool system for use in a well bore having a tubing string including a landing nipple forming a part thereof, said system comprising: a locking sub having a housing connectible on a lock mandrel releasably secured in said landing nipple, means providing a longitudinal bore through said housing opening into the bore through said lock mandrel, a first cam sleeve concentrically disposed in said housing around said bore and held against longitudinal movement therein toward the end of said housing connectible with said lock mandrel, a second cam sleeve concentrically disposed in said housing around said bore through said housing longitudinally spaced from said first cam sleeve and supported for longitudinal movement to vary the distance between said first and second cam sleeves, a tubular operator member supporting said second cam sleeve, spring means engaged between said housing and said tubular operator member for biasing said second cam sleeve toward said first cam sleeve, said cam sleeves having internal annular cam shoulders at adjacent ends thereof, said cam shoulders sloping together radially outwardly, an annular piston concentrically disposed in said housing within said cam sleeves and provided with circumferentially spaced windows alignable between said adjacent ends of said cam sleeves, seal means between said annular piston and said housing, said annular piston being adapted for limited movement in said housing toward said end of said housing connectible with said lock mandrel, a locking lug in each of said windows of said annular piston for radial movement between inward locking positions and outward release positions, said lugs each having outer arcuate cam shoulders at opposite ends of said lugs for engagement with said cam shoulders on said cam sleeves and inner cam shoulders on opposite ends thereof for engagement with a locking probed disposed through said annular piston, said outer locking shoulders being adapted to coact with said locking shoulders on said cam sleeves for urging said locking lugs inwardly to said locking positions responsive to the biasing force of said operator member urging said second cam sleeve toward said first cam sleeve and said inner cam shoulders on said locking lugs being adapted to urge said locking lugs outwardly to said release positions responsive to engagement by operating cam surfaces along said locking probe; and a locking probe insertable into said locking sub, said locking probe having a first tapered end portion providing an entry cam surface for engaging and expanding said locking lugs and a longitudinally spaced external annular locking recess defined between opposite end inwardly converging sloping cam release shoulders for expanding said locking lugs to release said locking probe from said locking sub, said first entry cam surface sloping at a first angle of inclination with the longitudinal axis of said probe, said second release cam surfaces sloping at a second angle of inclination with said longitudinal axis of said probe, said second angle of inclination being greater than said first angle of inclination of said entry cam surface whereby said probe is insertable into said locking sub responsive to a first longitudinal force toward said sub and is releasable from said locking sub responsive to a greater second force away from said locking sub, and means for connecting said locking probe with a well tool adapted to be releasably locked in said well bore by coaction of said locking probe and said locking sub.

16. A well tool system in accordance with claim 15 including external annular seal means on said locking probe for sealing around said locking probe within said annular piston of said locking sub.

17. A well tool system in accordance with claim 16 wherein said locking probe is provided with a longitudinal bore therethrough and including an equalizing valve connected with said locking probe, said equalizing valve having a port communicating said bore through said probe with said well bore for pressure release along said bore of said probe during running and pulling of said probe and means connected with said equalizing valve for supporting said valve and said probe in a well bore and communicating said valve with a well tool connected with said valve.

18. A well tool system in accordance with claim 17 wherein said equalizing valve comprises: an outer tubular housing having a head end provided with fluid flow passages for communicating with said well tool connected with said equalizing valve; a longitudinally movable valve-mandrel member supported in said housing connected at an end opposite said head end of said housing with said locking probe and having a longitudinal bore communicating with said bore through said locking probe, said valve-mandrel member having radially opening ports communicating with said bore through said member, said valve-mandrel member being movable from a first closed position to a second open position; said housing having a side port communicating with said radial ports of said valve-mandrel member when said member is at said second open position; said housing having flow passage means communicating with said passage means in said head end of said housing for fluid communication from said bore through said valve-mandrel member and said head end flow passages when said valve-mandrel member is at said first position; and spring means engaged between said housing and said valve-mandrel member biasing said member toward said second open position; and said valve-mandrel member and said housing being connected to move in telescopic relationship whereby oppositely directioned forces applied to said housing and to said valve-mandrel member move said valve-mandrel member from said first closed position to said second open position.

19. A well tool system in accordance with claim 18 including shock absorber means in said equalizing valve comprising a shock absorbing spring disposed between said housing and said valve-mandrel member; a first spring stop member between said housing and said valve-mandrel member and engageable with one end of said spring, said first stop member being movable longitudinally relative to both said valve-mandrel member and said housing and being engageable with a stop shoulder on said valve-mandrel member and a stop shoulder in said housing; and a second spring stop member between said valve-mandrel member and said housing and engageable with the second opposite end of said spring, said second stop member being movable longitudinally relative to said valve-mandrel member and said housing and being engageable with stop shoulders on said valve-mandrel member and within said housing; said spring being compressible responsive to relative movement of either of said valve-mandrel member and said housing respective to the other for absorbing impact forces to minimize the effect of such forces along said housing.

20. A well tool system in accordance with claim 19 wherein said equalizing valve includes means defining a chamber within said head of said housing around an end portion of said valve-mandrel member therein and means defining a bleed port through the wall of said housing communicating into said chamber.

21. A well tool system in accordance with claim 20 wherein said locking sub includes said internal cam shoulders on said locking lugs formed at angles of inclination with the longitudinal axis through said sub of a value less than the angle of inclination of said locking shoulder surface around the end of said first fixed cam sleeve and the cam surface on said locking lugs engageable with said cam surface on said first fixed cam sleeve, the differential between said angles of inclination being sufficient to permit retraction of the locking probe from said locking sub without jamming of said locking lugs as said locking lugs are urged outwardly to release said locking probe.

* * * * *

UNITED STATES PATENT AND TRADEMARK OFFICE

CERTIFICATE OF CORRECTION

PATENT NO. : 4,149,593

DATED : April 17, 1979

INVENTOR(S) : Imre I. Gazda and George F. Kingelin

It is certified that error appears in the above-identified patent and that said Letters Patent are hereby corrected as shown below:

| | |
|---|---|
| Column 6, line 28, | after "72" delete "of" and insert --within--. |
| Column 13, line 9, | cancel "poition" and insert --position--. |
| Column 15, line 33, | cancel "comprising" and insert --compressing--. |

Signed and Sealed this

*Eighteenth* Day of *September 1979*

[SEAL]

*Attest:*

*Attesting Officer*

LUTRELLE F. PARKER

*Acting Commissioner of Patents and Trademarks*